US007077121B1

(12) United States Patent
Havill

(10) Patent No.: US 7,077,121 B1
(45) **Date of Patent: *Jul. 18, 2006**

(54) BLOCK IMPACT SPLITTER

(75) Inventor: Ian Havill, Mascouche (CA)

(73) Assignee: Techo-Bloc Inc., St-Hubert (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/159,187

(22) Filed: Jun. 23, 2005

(51) Int. Cl.
*B28D 1/32* (2006.01)

(52) U.S. Cl. ..... 125/23.01; 83/468; 144/193.1

(58) Field of Classification Search ..... 125/23.01, 125/23.02; 83/468, 468.7, 268, 247; 144/193.1, 144/195.4; 254/124, 93 R
See application file for complete search history.

(56) References Cited

U.S. PATENT DOCUMENTS 4,782,867 A * 11/1988 Forsyth ..... 144/195.2
5,535,795 A * 7/1996 Bunn ..... 144/195.4
5,662,094 A * 9/1997 Giacomelli ..... 125/23.01
2005/0133114 A1 * 6/2005 Peterson ..... 144/193.1

* cited by examiner

*Primary Examiner*—Lee D. Wilson
(74) *Attorney, Agent, or Firm*—Ogilvy Renault LLP; Guy J. Houle

(57) ABSTRACT

A block impact splitter is comprised of a support frame connected on a swivel to a stationary frame. A hammer is provided with a hammer head and secured to a pivotal arm pivotally connected to the support frame at a pivot connection. An actuating piston has a cylinder end thereof pivotally connected to the support frame and a piston rod end pivotally connected to the pivotal arm. The actuating piston displaces the hammer head to impact against a pitching blade assembly and to retract it therefrom. The pitching blade assembly has a pivotal support arm to which is secured a pitching blade. An adjusting mechanism positions the pitching blade relative to a block to be split along a parting slot of the block.

18 Claims, 3 Drawing Sheets

BLOCK IMPACT SPLITTER

TECHNICAL FIELD

The present invention relates to a block impact splitter provided with a hammer assembly which is piston operated to strike against a pitching blade which is automatically positioned precisely above a parting slot provided in a concrete casted block to be split.

BACKGROUND ART

Devices have been constructed for over one hundred years to split blocks by the use of wedges. For example, in U.S. Pat. 630,983 issued in 1899, there is described an apparatus for splitting stones wherein a stone is mounted on a support behind a stationary wedge and a second wedge is secured to a pendulum hammer wedge hinged by stirrups whereby to swing down the hammer wedge against the stone so that the wedge strikes the stone in substantially the same plane as the stationary wedge so that the stone is impacted with wedges from opposed surfaces thereof. Several other devices have also been developed and wherein the wedges are brought down against the stone at more precise locations by mounting wedges on displaceable supports which are displaced by a threaded rod to which is imparted rotation by rotating a wheel secured to the threaded rod. The force applied to the splitting wedge is that of the force applied on the wheel by a worker. All of these devices are slow, labor intensive, time-consuming and do not provide accurate splitting of stones thereby resulting in excessive material waste. Some of these are also dangerous to operate and can cause body injuries.

Paving stones are now casted from concrete and with some of these it is desirable to split the casted concrete stones whereby to form two stones with a split face whereby the split face is jaggered by exposing the aggregate and thereby closely resembles that of a natural stone. In order to split these stones they are casted with a parting slot on a face thereof whereby a splitting chisel or blade can be positioned therein and by the use of a hammer the stone is manually split. Some problems with this technique is that it is slow and the hammer blow is never of the same force and often it is necessary to impart two or more hammer blows to a chisel to split the stone as the stone resistance in the area of the parting line may vary depending on the aggregate distribution under the parting slot. Such techniques are also hazardous in that chips of stone may injure the person splitting the stone. They also result in some stone waste by improper splitting.

Another disadvantage is that the stones need to be transferred one at a time to a splitter and then back onto a pallet or storage plate. This is labour intensive, hazardous and costly.

SUMMARY OF INVENTION

There is therefore a need to provide a block splitter which substantially overcomes the above-mentioned disadvantages of the prior art.

It is a feature of the present invention to provide a block impact splitter which is fully automatic and which can split several pre-casted concrete stones at the same time and at a precise location and wherein the block impact splitter is self-aligning to the position of the stones on a support surface.

Another feature of the present invention is to provide a block impact splitter capable of receiving block supporting production plates having a plurality of precasted concrete blocks and wherein a plurality of block impact splitters are automatically and individually positioned with respect to an associated block for splitting several blocks at the same time.

Another feature of the present invention is to provide a block impact splitter utilizing a hammer which is operated by a piston to provide an impact force on a pitching blade which is precisely positioned at a predetermined position with respect to a casted concrete block to be split.

Another feature of the present invention is that the blocks are casted, transported and split on their support plate without having to be removed or transferred therefrom.

According to the above features, from a broad aspect, the present invention provides a block impact splitter which comprises a support frame. A hammer having a hammer head is secured to a pivotal arm pivotally connected to the support frame at a pivot connection. An actuating piston, having a cylinder end pivotally connected to the frame and a piston rod end pivotally connected to the pivotal arm is also provided. The actuating piston displaces the hammer head to impact against a pitching blade assembly and to retract it therefrom. The pitching blade assembly has a pivotal support arm pivotally connected to the frame and to which is secured a pitching blade. Means is provided to adjust the position of the pitching blade relative to a block to be split whereby on a downstroke of the pitching blade, when impacted by the hammer head, the pitching blade will apply an impact force at a predetermined position on a face of a block positioned under the pitching blade to split the block at the predetermined position.

According to a still further broad aspect of the present invention there is provided a method of producing split casted concrete blocks. The method comprises the steps of providing a production plate adapted to support one or more casted blocks. One or more of these blocks are casted on the production plate. A parting slot is formed on a top surface of each of the one or more blocks. The production plate is transported to a support surface of a block splitting machine. Each of the blocks is impacted with a pitching blade aligned with the parting slot of a respective one of the one or more casted blocks to form the split blocks on the production plate.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
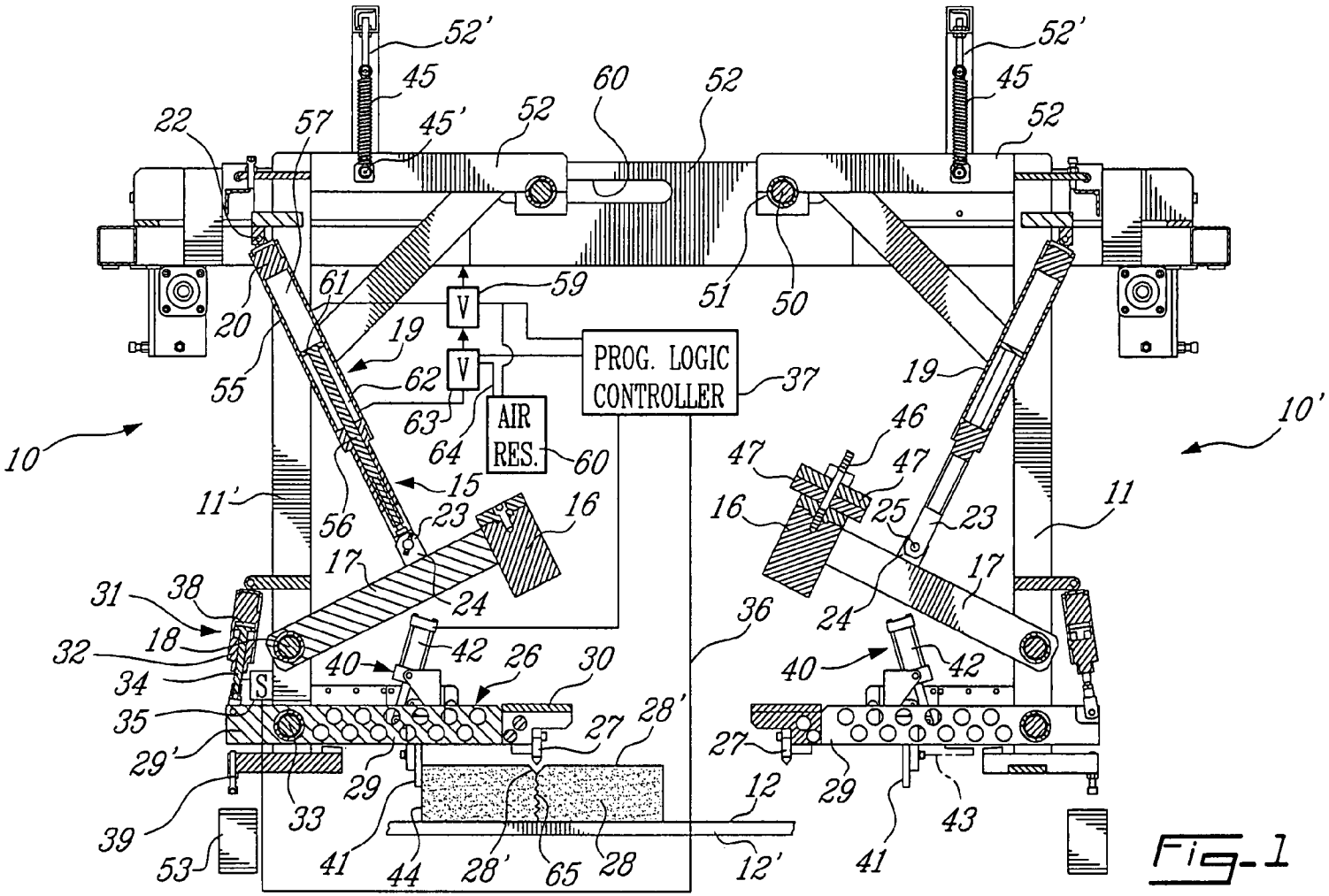
FIG. 1 is a side view showing two block impact splitters, herein a pair of block impact splitters supported in transverse aligned position on a stationary frame.
Figure 2:
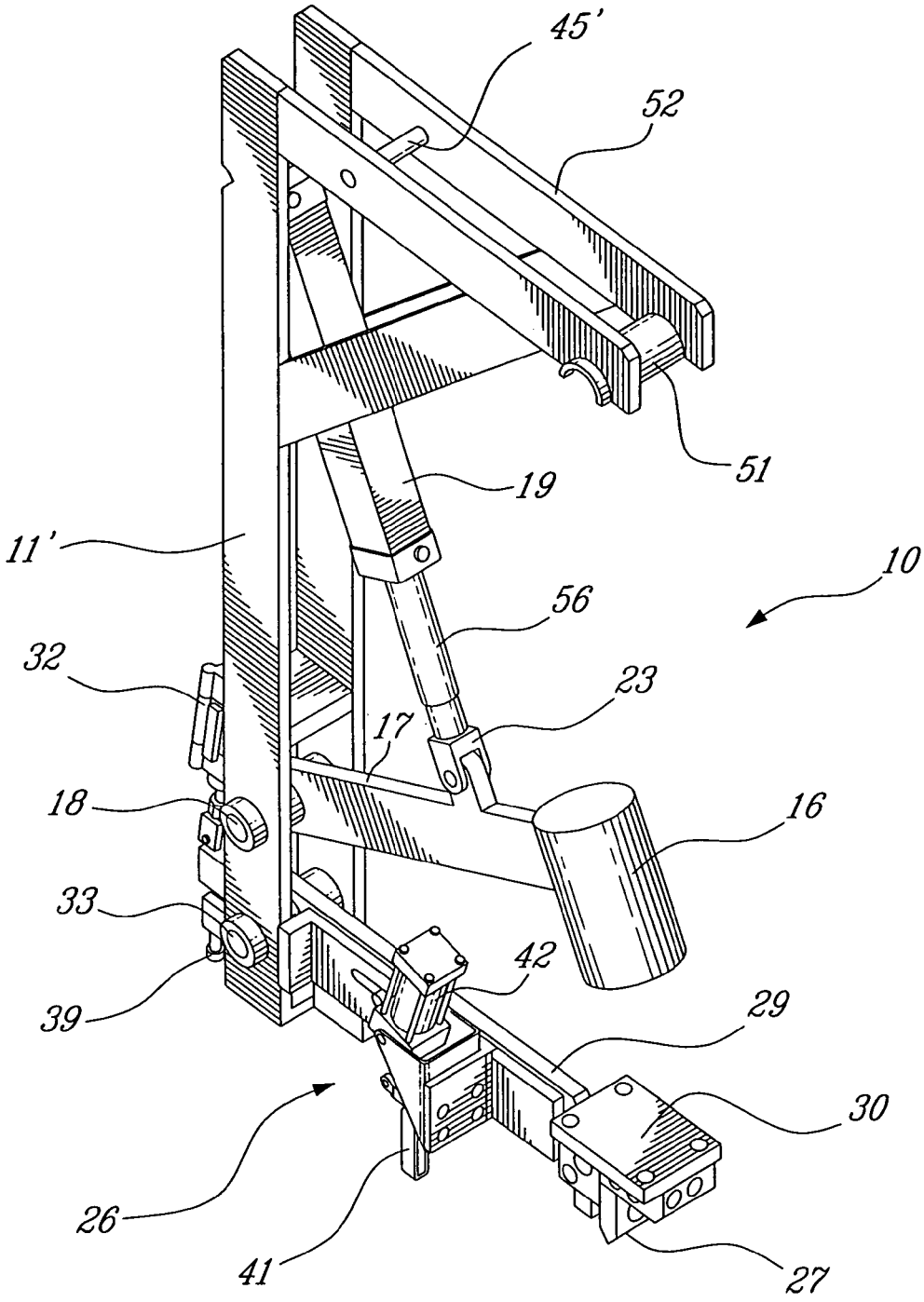
FIG. 2 is a perspective view showing the construction of a block impact splitter constructed in accordance with the present invention.
Figure 3:
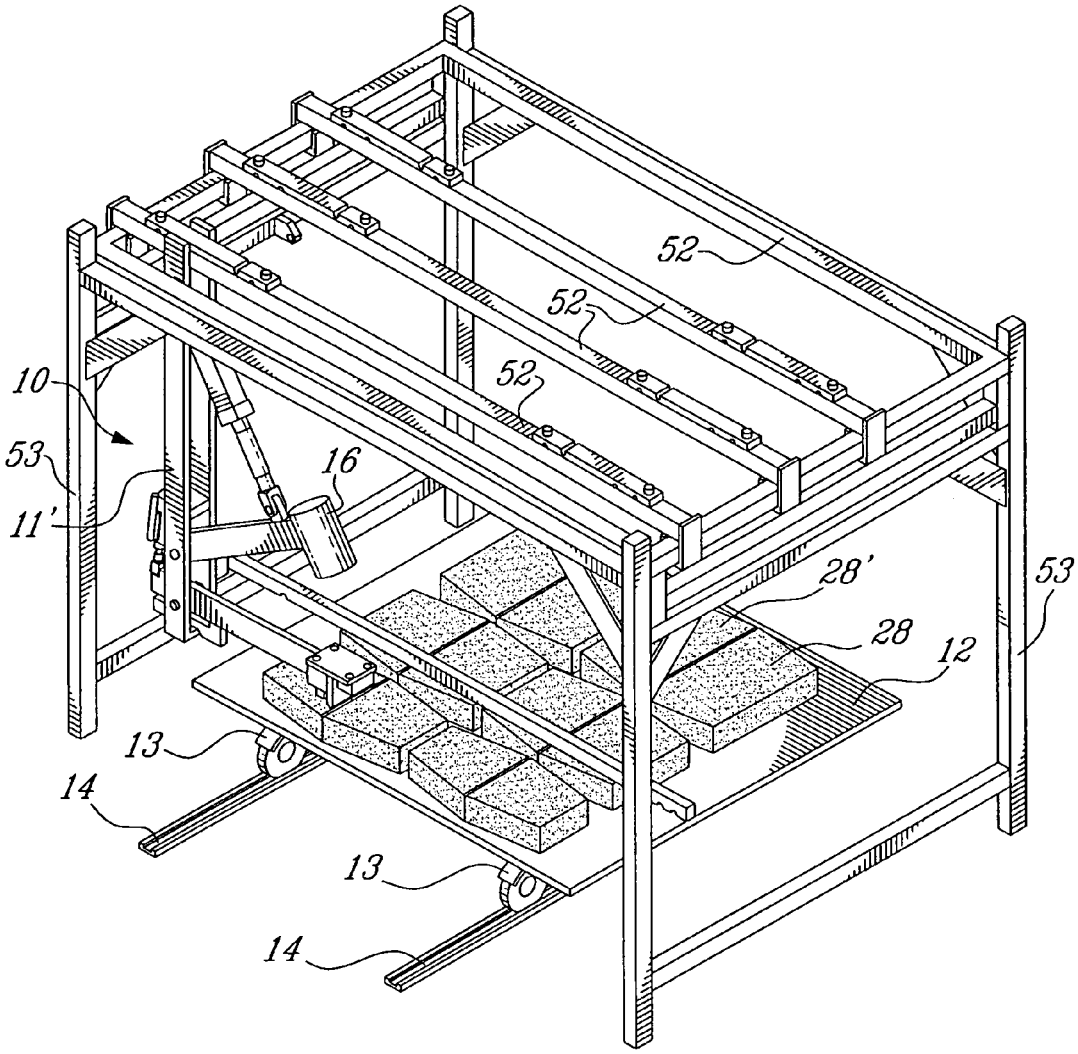
FIG. 3 is a perspective view showing a stationary frame on which is securable six block impact splitters which are pivotally mounted to the frame in opposed pairs and above a block support plate.

Referring now to the drawings and more specifically to FIGS. 1 and 2, there is shown generally at 10 a block impact splitter constructed in accordance with the present invention. As illustrated in FIG. 1, there are two block impact splitters 10 and 10' secured in transverse alignment with one another on support frames 11 and 11', respectively. A block support surface 12 is disposed at a precise position relative to the frame 11. The block support surface 12 is herein constituted by a block support production plate 12' which is displaceable under the frame 11 by displaceable support means which, as shown in FIG. 3, is provided by a carriage 13 displaceable on tracks 14 disposed under the frame 11. However, other types of mechanisms can be provided to position the plate under the splitters 10 and 10'. An important feature of the present invention is that the blocks are casted on their production plate 12', transported and split without having to be transferred to another support plate.

The block impact splitters 10 and 10' comprise a hammer assembly 15 having a hammer head 16 which is secured to a pivotal arm 17 pivotally mounted on a pivot connection 18 to an upright member 11' of the support frame 11. An actuating piston 19 has a cylinder end 20 pivotally connected to the frame, herein a bracket 21 secured to the upright member 11' by a pivot connection 22. A piston rod end 23 of the actuating piston 19 is pivotally connected to a bracket 24 secured to the pivotal arm 17 on a pivot connection 25.

The actuating piston 19 displaces the hammer head 16 in a rapid motion to impact against a pitching blade assembly 26 to impact the hammer head 16 on a pitching blade 27 to split a block 28 positioned thereunder. The hammer head 16 is then retracted to its standby position as illustrated in FIG. 1.

The pitching blade assembly 26 has a pivotal support arm 29 to which is secured the pitching blade 27 at a free end thereof. An impact head 30 constructed from steel is secured to the pivotal support arm above the pitching blade 27 to receive the impact blow from the hammer head 16 and transfer it to the pitching blade 27. A blade positioner 31 is provided with a blade positioning cylinder 32 which is secured to a rear extension section 29' of the pivotal support arm 29 to position the blade 27 to a standby position as illustrated in FIG. 1. The pivotal support arm 29 is pivotally mounted to the upright member 11' by a pivot connection 33.

The blade positioner 31 has a detection means by sensing the displacement of the cylinder rod 34 when an impact force is applied to the impact head 30 causing the pivotal support arm 29 to pivot on the pivot connection 33 pushing against the cylinder 34. A switch 35 may be provided for this detection and it is connected through its connection 36 to a program logic controller device 37 which senses that the pitching blade has been imparted a pitching force to split the stone 28. This triggers the retraction cycle of the hammer head 16.

When the hammer head 16 is retracted to its standby position as illustrated in FIG. 1, the piston cylinder 32 is actuated whereby to tilt the pitching blade 27 upwardly to clear the space thereunder for receiving another plate 12' with stones to be split. The upstroke of the pivotal support arm 29 is adjustable by a threaded bolt 39 provided under the extension end section 29' of the pivotal support arm 29. It is pointed out that the piston rod end 34 is not at a fully extended stroke when the pitching blade 27 is positioned at its standby position to permit the piston rod to move slightly within the piston cylinder housing 38 to cushion the blow and to detect the displacement of the pitching blade during the impact stroke to generate a signal.

The pitching blade assembly 26 is further provided with a means to adjust the position of the pitching blade 27 relative to the block 28 to be split and more precisely relative to a parting slot 28' provided in the top surface 28" of the block 28. This means is comprised by a pitching blade aligning arm assembly 40 which is secured to the pivotal support arm 29 for adjusting the lateral position of the pitching blade 27 relative to the block 28. The pitching blade aligning arm assembly 40 is slidably displaceable along the pivotal support arm 29 at precise increments whereby to handle stones of different sizes and to position the pitching blade 27 at a precise location with respect to the stone sizes. The pitching blade aligning arm assembly 40 is provided with a pivotal hand 41 which is actuable by the piston 42 to position same from a retracted position, as shown by phantom lines 43, to a vertical working position as herein illustrated in solid line. As hereinshown the support frame 11 is suspended on a swivel support 50 by a bushing 51 secured to an overhead stationary frame member 52. Accordingly, the support frame 11 can swing on the swivel support 50 and this is necessary to position the splitting blade 27 at a precise location with respect to the position of a block to be split on the support surface 12. It is pointed out that these support blocks are never disposed at precise locations and for this particular device the tolerance of this position can vary within an inch and a half in distance. When the pivotal hand 41 is lowered to its vertical position, it will engage an edge surface, such as edge 44 of the stone 28 to be split, to position the pitching blade 27 at a precise location relative to the edge of the block engaged by the hand 41 supported on the steel plate 12. A spring 45 is secured to the frame horizontal beam 52 at 45' and the stationary frame 52 on an upright 52" to compensate for the offset weight of the hammer assembly 15 relative to the upright 1' and particularly to the weight of the hammer head 16.

As shown in FIG. 1, the head 16 may be provided with a rear extension pin 46 for receiving weighted discs 47 to adjust the weight of the hammer head and consequently the impact force of the head on the pitching blade.

As herein shown, the actuating piston 19 has an air cylinder 55 to displace the piston rod 56 for actuating the hammer head 16. An air pressure reservoir 60 is connected to a rear chamber 57 of the piston through a hose 58 and a valve 59 which is actuable by the program logic controller 37 to pressurize the rear chamber 57 and to evacuate air therefrom. The air cylinder 55 has a front chamber 62 and the piston rod head 61 is displaced by controlling the air in these chambers 57 and 62.

Accordingly, in order to effect the downstroke of the hammer head 16, air from the front chamber 62 is evacuated through valve 63 which is operated by the controller 37 and simultaneously air pressure is applied in the rear chamber 57. This causes the hammer head to be released quickly and impact against the steel disc or impact head 30 to cause the splitter blade 27 to impact against the block and impart a splitting force to split the block exposing a jaggered aggregate face 65 on opposed split faces of the block 28 thereby resulting in two blocks each having a jaggered face resembling real stone.

During the retracting stroke of the hammer head 16 the rear chamber is evacuated to atmosphere through the valve 59 and air pressure is applied to the front chamber 62 through valve 63 which is also connected by a line 64 to the pressurized air pressure reservoir 60. This sequence is initiated by the controller 37.

Accordingly, the program logic controller 37 operates the actuating piston 19 and initiates the downward stroke after receiving signals from the positioner assembly 40 after the controller has received a signal from the switch 35 that the pitching blade has effected a pitching cycle. The program logic controller also receives a signal that the pivotal hand 41 is in engagement with a block to be split.

Referring now to FIG. 3, it can be seen that these block impact splitters 10 are mounted in an assembly on overhead stationary frame members 52 secured to uprights 70 of a stationary frame. In FIG. 3 only one block impact splitter 10 is herein shown but these block impact splitters 10 are mounted in pairs on the overhead frame members 52 and suspended therefrom on their swivel connection. The impact splitters 10 have their suspended frame 11 adjustably secured in an adjustment slot 60. Each block impact splitter of each pair is in transverse alignment. The frame as hereinshown is adapted to support three pairs of these block impact splitters. As hereinshown, there are six concrete casted blocks 28, each of which is associated with a splitter 10 and each of which is provided with a parting slot 28'. Each of the block impact splitters automatically positions its pitching blade at a standby position, as above-described, and over the parting slots of its associated block 28 and once this is detected by the controller all six hammer heads 16 are released simultaneously. The hammer is then retracted as well as the pivotal support arm of the pitching blade and the block support steel plate 12' is carried away on the carriage 13 which is supported on the rails 14 and a further production plate 12' with another six stones are brought into position under the block impact splitters. It is pointed out that these precasted concrete blocks are casted on these steel plates and dried thereon. It is therefore not necessary to manipulate the blocks for the splitting cycle. They remain on their support production plate 12'. After splitting, the production plate 12' is conveyed to a block discharge station. Also, most of the dust and particles of the precasted stones remain on the production plate 12' and are evacuated at a remote location. The plate 12' can be a steel, wood or plastic plate.

As can be appreciated, this system of splitting blocks is fully automated and only requires personnel to move the production plate and to initiate the controller although most of this work can be done automatically. For example, the production plate 12' could be adapted to trip a switch when it reaches its rest position within the frame 11 under the plate impact splitters 10 thereby initiating the splitting cycle. It can also be discharged automatically with a further support table being advanced within the frame 11 to again initiate the splitters once it reaches its position. As previously described, each of the block impact splitters automatically adjust to the positions of the blocks and is also provided with adjustable means to adapt for splitting blocks of different sizes. Although the stationary frame as hereinshown is provided with six blade splitters, it is also conceivable that the frame can have many more splitters and that only selected ones are programmed to operate depending on the number of blocks that are to be placed on the support production plate 12'.

It is within the ambit of the present invention to cover any obvious modifications of the preferred embodiment described herein provides such modifications fall within the scope of the appended claims.

I claim:

1. A block impact splitter comprising a support frame, a hammer assembly having a hammer head secured to a pivotal arm pivotally connected to said support frame at a pivot connection, an actuating piston having a cylinder end pivotally connected to said frame and a piston rod end pivotally connected to said pivotal arm, said actuating piston displacing said hammer head to impact against a pitching blade assembly and to retract said hammer head therefrom, said pitching blade assembly having a pivotal support arm pivotally connected to said frame and to which is secured a pitching blade, and means to adjust the position of said pitching blade relative to a block to be split whereby on a downstroke of said pitching blade when impacted by said hammer head said pitching blade will apply an impact force at a predetermined position on a face of a block positioned adjacent said pitching blade to split said block at said predetermined position.

2. The block impact splitter as claimed in claim 1 wherein said pitching blade assembly further comprises a blade positioner comprising a blade positioning cylinder secured to a rear extension section of said pivotal support arm to position said blade to a stand-by position, and detection means to detect an impact position of said pitching blade.

3. The block impact splitter as claimed in claim 2 wherein said detection means is a switch sensor secured to a cylinder rod of said positioning cylinder to detect axial movement thereof during displacement of said pitching blade when impacted by said hammer head.

4. The block impact splitter as claimed in claim 2 wherein there is further provided an upstroke positioner for limiting the upstroke of said pivotal support arm, said positioner being comprised of an adjustment threaded bolt having an arresting end secured in spaced alignment under said rear extension section of said pivotal support arm.

5. The block impact splitter as claimed in claim 1 wherein said means to adjust the position of said pitching blade comprises a pitching blade aligning arm assembly secured to said pivotal support arm for adjusting the lateral position of said pitching blade relative to a block to be split.

6. The block impact splitter as claimed in claim 5 wherein said support frame is suspended on a swivel support with an overhead stationary frame, said pitching blade aligning arm assembly having a pivotal hand which is actuable by a piston to position same from a retracted position to a vertical blade aligning position, said pivotal hand when at said vertical position engaging an edge surface of a block to be split and displacing said support frame on said swivel connection whereby said pitching blade is positioned at a stand-by position above said predetermined position on a face of said block to be split.

7. The block impact splitter as claimed in claim 6 wherein there is further provided a compensator spring secured to said support frame and to a stationary frame member to maintain said support frame to compensate for an offset weight of said hammer head.

8. The block impact splitter as claimed in claim 6 wherein said block support surface is a support table, said overhead stationary frame having vertical riser beams and horizontal support beams, said support frame having an attachment arm with said swivel connection constituted by a bushing secured about a pivot rod secured to one of said horizontal support beams.

9. The block impact splitter as claimed in claim 8 wherein there is a pair of said block impact splitters supported by said overhead frame in spaced transverse alignment with one another, and wherein there are two concrete casted blocks positioned in transverse alignment on said support table, said concrete casted blocks being split by a respective one of said two block impact splitters.

10. The block impact splitter as claimed in claim 9 wherein there is at least three of said pairs of block impact splitters and six of said concrete casted blocks.

11. The block impact splitter as claimed in claim 10 wherein said support table is a block support production plate on which said concrete blocks are casted and dried before being split, said support production plate transporting said casted blocks, said blocks being casted with a parting slot on a top surface thereof, each block being engaged by a pivotal hand of an associated block impact splitter to position said pitching blade in alignment above said parting slot by adjusting the position of said frame on said swivel support.

12. The block impact splitter as claimed in claim 11 wherein said block support table is removed from said support frame and replaced with another block support table with casted concrete blocks after the splitting of all said blocks.

13. The block impact splitter as claimed in claim 5 wherein said pitching blade aligning arm assembly is slidably adjustable along said pivotal support arm.

14. The block impact splitter as claimed in claim 1 wherein said pitching blade assembly further comprises an impact head secured to said pitching blade to receive said impact force of said hammer head and transfer same to said pitching blade.

15. The block impact splitter as claimed in claim 14 wherein said impact head is a steel disc, said hammer head being a solid steel hammer head.

16. The block impact splitter as claimed in claim 15 wherein said hammer head is provided with a disc support means for receiving weighted discs to adjust the weight of said hammer head.

17. The block impact splitter as claimed in claim 1 wherein said actuating piston has an air cylinder to displace a piston rod for actuating said hammer head, an air pressure reservoir connected to a rear chamber of said cylinder through a first valve to cause said piston rod to extend out of said cylinder quickly when pressure in a front chamber is evacuated whereby to cause said hammer head to impact said pitching blade assembly, said rear chamber evacuating to atmosphere during a retraction stroke of said piston rod by the application of air under pressure in said front chamber which is also connected to said air pressure reservoir through a second valve.

18. The block impact splitter as claimed in claim 1 wherein there is further provided a programmable logic controller to control and synchronize the operation of said block impact splitter.

* * * * *